US011203514B2

(12) United States Patent
Kuwano

(10) Patent No.: US 11,203,514 B2
(45) Date of Patent: Dec. 21, 2021

(54) ASEPTIC FILLING SYSTEM

(71) Applicant: Dai Nippon Printing Co., Ltd., Tokyo (JP)

(72) Inventor: Seiji Kuwano, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 64 days.

(21) Appl. No.: 16/620,109

(22) PCT Filed: Jun. 28, 2018

(86) PCT No.: PCT/JP2018/024512
§ 371 (c)(1),
(2) Date: Dec. 6, 2019

(87) PCT Pub. No.: WO2019/009169
PCT Pub. Date: Jan. 10, 2019

(65) Prior Publication Data

US 2020/0198955 A1 Jun. 25, 2020

(30) Foreign Application Priority Data

Jul. 4, 2017 (JP) ..... JP2017-131463

(51) Int. Cl.
*B67C 7/00* (2006.01)
*B67C 3/22* (2006.01)
(Continued)

(52) U.S. Cl.
CPC ..... *B67C 7/0073* (2013.01); *B67C 3/22* (2013.01); *B67C 3/2642* (2013.01);
(Continued)

(58) Field of Classification Search
CPC ..... B67C 7/0073; B67C 3/00; B67C 3/02; B67C 3/22; B67C 3/2642; B67C 2003/228; B65B 3/10; B08B 3/00
(Continued)

(56) References Cited

U.S. PATENT DOCUMENTS

2006/0137761 A1* 6/2006 Takeda ..... B67C 3/045 141/59
2013/0059055 A1 3/2013 Richter et al.
(Continued)

FOREIGN PATENT DOCUMENTS

CN 103040071 A 4/2013
CN 105246821 A 1/2016
(Continued)

OTHER PUBLICATIONS

Chinese Office Action (Application No. 201880044004.6) dated Mar. 8, 2021 (with English translation).
(Continued)

*Primary Examiner* — Valentin Neacsu
*Assistant Examiner* — Jacob A Smith
(74) *Attorney, Agent, or Firm* — Burr & Brown, PLLC

(57) ABSTRACT

An aseptic filling system includes a heat sterilizer and a filler. The heat sterilizer has a heating unit, a holding tube, a first stage cooling unit and a second stage cooling unit. A circulation line composed of a heating-water line and a cooling-water line is connected to the heating unit and the first stage cooling unit. A connection line is connected to the cooling-water line, and aseptic cooling water in the cooling-water line is sent to the filler through the connection line.

4 Claims, 2 Drawing Sheets

(51) Int. Cl.
*B67C 3/26* (2006.01)
*B67C 3/00* (2006.01)
*B08B 9/032* (2006.01)

(52) U.S. Cl.
CPC ..... *B08B 9/0325* (2013.01); *B08B 2230/01* (2013.01); *B67C 3/001* (2013.01); *B67C 2003/228* (2013.01)

(58) Field of Classification Search
USPC ..... 53/127, 426
See application file for complete search history.

(56) References Cited

U.S. PATENT DOCUMENTS

| | | | | |
|---|---|---|---|---|
| 2014/0123475 | A1* | 5/2014 | Farina | H01M 10/12 29/623.1 |
| 2016/0121376 | A1 | 5/2016 | Hayakawa et al. | |
| 2016/0185584 | A1* | 6/2016 | Hayakawa | B08B 9/027 53/426 |
| 2017/0290938 | A1* | 10/2017 | Hayakawa | A61L 2/18 |
| 2018/0334372 | A1* | 11/2018 | Hayakawa | B67C 7/00 |
| 2020/0017344 | A1* | 1/2020 | Mueller | B67C 3/001 |

FOREIGN PATENT DOCUMENTS

| | | | | | |
|---|---|---|---|---|---|
| EP | 2 937 309 | A1 | | 10/2015 | |
| EP | 3 015 418 | A1 | | 5/2016 | |
| JP | 5674485 | A | * | 6/1981 | B67C 3/02 |
| JP | S56-074485 | A1 | | 6/1981 | |
| JP | 11208782 | A | * | 8/1999 | B67C 3/00 |
| JP | H11-208782 | A1 | | 8/1999 | |
| JP | 2007022600 | A | * | 7/2005 | B67C 3/00 |
| JP | 2007-022600 | A1 | | 2/2007 | |
| JP | 2011-255938 | A1 | | 12/2011 | |
| JP | 2015-006922 | A1 | | 1/2015 | |
| JP | 2015006922 | A | * | 1/2015 | B67C 3/00 |
| JP | 2015-044593 | A1 | | 3/2015 | |
| WO | 2014/098058 | A1 | | 6/2014 | |

OTHER PUBLICATIONS

Japanese Office Action (Application No. 2017-131463) dated Sep. 11, 2018 (with English translation).
International Search Report and Written Opinion (Application No. PCT/JP2018/024512) dated Sep. 18, 2018.
English translation of International Preliminary Report on Patentability (Application No. PCT/JP2018/024512) dated Jan. 16, 2020.
Extended European Search Report (Application No. 18827605.9) dated Mar. 9, 2021.
Chinese Office Action (Application No. 20188004004.6) dated Oct. 15, 2021 (with English translation).

* cited by examiner

ASEPTIC FILLING SYSTEM

FIELD OF THE INVENTION

The present invention relates to an aseptic filling system for filling a container, such as PET bottle, with a beverage (content).

BACKGROUND ART

An aseptic filling system for filling a container, such as a bottle, with a beverage has been conventionally known. Such an aseptic filling system comprises a heat sterilizer for heating a beverage, and filling machine. The filling machine includes an aseptic chamber wherein a bottle is filled with a beverage.

Air having passed through a sterilization filter is supplied into the aseptic chamber of the filling machine, so as to maintain the aseptic condition in the aseptic chamber.

Patent Document 1: JP2011-255938A

Patent Document 2: JP2015-44593A

SUMMARY OF THE INVENTION

A heat sterilizer uses heated aseptic water in order to heat a beverage.

On the other hand, since an aseptic chamber of a filling machine is supplied with a small amount of aseptic water for lubrication or the like, an aseptic-water generator is needed. If the aseptic-water generator can be omitted, installation cost and operation cost can be reduced as a whole.

The present invention has been made in view of the above problem. The object of the present invention is to provide an aseptic filling system capable of reducing installation cost and operation cost as a whole.

The present invention is an aseptic filling system comprising: a heat sterilizer that sterilizes a content by heat; and a filling machine that fills a bottle with the content sterilized by heat by the heat sterilizer; wherein: the heat sterilizer includes a heating unit that heats the content, and a cooling unit that cools the content heated by the heating unit; a circulation line that circulates aseptic water is connected between the heating unit and the cooling unit, the circulation line including a heating-water line that supplies the heating unit with heating water from the cooling unit, and a cooling-water line that supplies the cooling unit with cooling water from the heating unit; and the cooling-water line is provided with a connection line that supplies aseptic water to the filling machine.

The present invention is the aseptic filling system wherein the filling machine includes an aseptic chamber; the connection line is connected to the aseptic chamber through a sprayer or a nozzle; and aseptic water is sprayed into the aseptic chamber by the sprayer or the nozzle.

The present invention is the aseptic filling system wherein the heating-water line is provided with a heating-steam supply unit.

According to the present invention, it is not necessary to additionally provide an aseptic-water generator for supplying aseptic water to an aseptic chamber of a filling machine, whereby cost can be reduced as a whole.

DETAILED DESCRIPTION OF THE INVENTION

An overall aseptic filling system 1A is firstly described with reference to FIG. 2.

Figure 2:
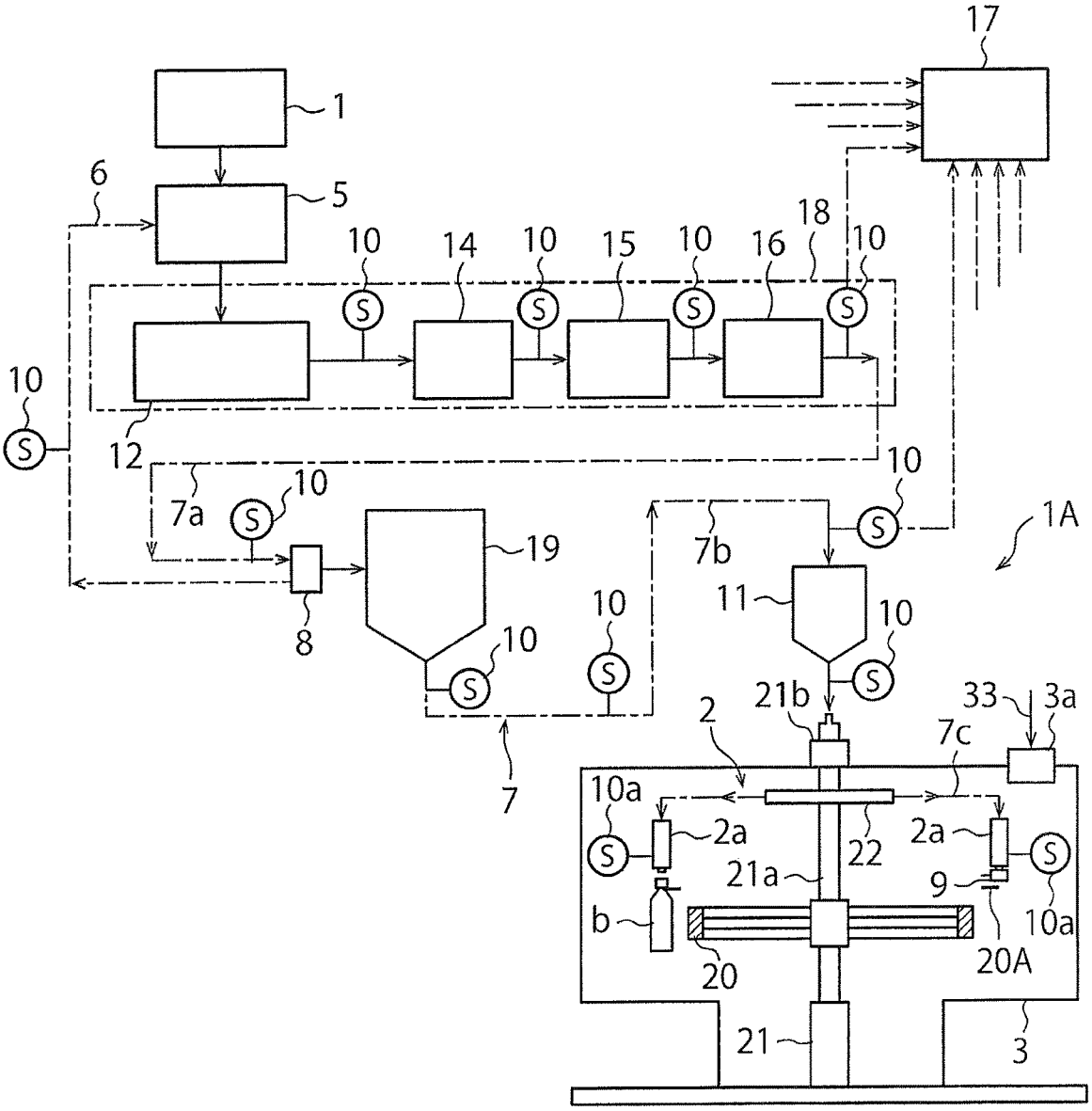
FIG. 2 is a block diagram of an aseptic filling system according to the present invention.

As shown in FIG. 2, the aseptic filling system 1A is configured to aseptically fill a plastic bottle (also referred to as container) b with a beverage (also referred to as content).

Such an aseptic filling system 1A comprises a preparation apparatus 1, a balance tank 5, a heat sterilizer (UHT) 18, a serge tank 19, a head tank 11, and a filler (also referred to as filling machine) including a filling nozzle 2*a* for aseptically filling a bottle b with a beverage, in this order.

The preparation apparatus 1 is configured to prepare beverages, such as tea beverages or fruit beverages, at respective desired preparation ratio.

The preparation apparatus 1 and the filling nozzle 2*a* in the filler 2 is connected through a beverage supply pipe 7.

In addition, the aseptic filling system 1A is provided with a bottle transport path through which a bottle b is transported to the filler 2, and through which a bottle b filled with a beverage by the filler 2 is discharged. The transport path is generally composed of a plurality of wheels 20, grippers 20A disposed around the respective wheels, and so on.

The filler 2 is a filling machine that fills a plurality of bottles b with a beverage at high speed. The filler 2 comprises an aseptic chamber 3, a plurality of filling nozzles 2*a* disposed in the aseptic chamber 3 for filling bottles b with a beverage, and a wheel 20 disposed in the aseptic chamber 3 and constituting a part of the transport path for a bottle b. The wheel 20 is mounted on a pivot shaft 21*a* extending from a support shaft 21 standing perpendicularly from a floor surface of the aseptic filling apparatus. The grippers 20A that grip a neck part of a bottle b are arranged around the wheel 20 at constant pitches. The grippers 20A can be rotated integrally with the wheel 20 in one direction. The filling nozzles 2*a* are mounted around the wheel 20 at the same pitches as the grippers 20A.

A rotary joint 21*b* is disposed on an upper end of the pivot shaft 21*a* extending upward from the support shaft 21. An upper manifold 22 is provided on the pivot shaft 21*a* below the rotary joint 21*b*. A part extending from an upper part of the support shaft 21 of the pivot shaft 21*a* up to the upper manifold 22 is hollow. A downstream pipe part 7*b* of the beverage supply pipe 7 is connected to the rotary joint 21*b*. In addition, a connection pipe part 7*c* extends between the upper manifold 22 and each filling nozzle 2*a*.

The wheel 20 is rotated at high speed by actuating the filler 2. In synch with the rotating movement of the wheel 20, bottles b gripped by the grippers 20A are transported on the transport path at high speed. When a bottle b reaches a position directly below a nozzle opening at a lower end of the filling nozzle 2*a*, the bottle b is filled with a predetermined amount of beverage. In this manner, bottles b are filled with a beverage in succession.

In order that the filler 2 can fill a sterilized bottle b with a sterilized beverage without any foreign matters such as microorganisms entering into the bottle b, the filler 2 as a whole is housed in the aseptic chamber 3, as described above. The aseptic chamber 3 has an inlet for bottle b, which is provided on the upstream side of the transport path for bottle b, and an outlet for bottle b, which is provided on the downstream side of the transport path for bottle b.

Next, the aseptic filling system 1A is further described. The beverage supply pipe 7 includes the upstream pipe part 7*a* and the downstream pipe part 7*b*. In the upstream pipe part 7*a* extending from the preparation apparatus 1 to reach the filler 2, the balance tank 5, the heat sterilizer (UHT (Ultra High-temperature)) 18, a manifold valve 8 and the serge tank 19 are disposed in this order from the upstream side to the downstream side. The head tank 11 is disposed in the downstream pipe part 7*b*.

The UHT 18 includes a heating unit 12 disposed therein, a holding tube 14, a first stage cooling unit 15 and a second stage cooling unit 16. A beverage supplied from the balance tank 5 is sent to the heating unit 12. The beverage is gradually heated in the heating unit 12, and is held at a target temperature in the holding tube 14. Thereafter, the beverage is sent to the first stage cooling unit 15 and the second stage cooling unit 16 so as to be gradually cooled. The number of stages of the heating unit(s) or the cooling unit(s) is increased or decreased according to need.

A return path 6 is disposed on the upstream pipe part 7*a* of the beverage supply pipe 7, which extends through the balance tank 5 and the UHT 18 to reach the manifold valve 8. The return path 6 is provided for performing Sterilizing in Place (SIP), and for circulating a liquid when no liquid can be supplied to the serge tank 19 in order to hold a pressure necessary for the UHT 18 to maintain a temperature of the holding tube 14 at a high temperature exceeding 100° C. after starting the sterilization.

In addition, in the upstream pipe part 7*a* of the beverage supply pipe 7, temperature sensors 10 are disposed at important positions in terms of operation of the UHT. These positions at which the temperature sensors 10 are disposed, may be, for example, in the path from the heating unit 12 in the UHT 18 toward the manifold valve 8, positions between the respective units in the UHT 18, a position on the downstream side of the second stage cooling unit 16, and a position on the upstream side of the manifold valve 8. The temperature sensors 10 are respectively disposed on these positions. Information about temperatures respectively measured by these temperature sensors 10 is transmitted to a controller 17.

In addition, in the downstream pipe part 7*b* of the beverage supply pipe 7, which extends from the serge tank 19 on the downstream side of the upstream pipe part 7*a* to reach the filler 2 through the head tank 11, the temperature sensors 10 are disposed on respective positions including a poison at which a temperature thereof is not easily elevated when supplied with heating steam or the like. These positions at which the temperature sensors 10 are disposed may be, for example, in the path from the serge tank 19 toward the filling nozzle 2*a*, a position near an outlet of the serge tank 19, an intermediate position of a bent portion, which is a low position in which steam condenses so that a temperature lowers, a position near an inlet of the head tank 11, and a position near an outlet of the head tank 11. Information about temperatures respectively measured by these temperature sensors 10 is transmitted to a controller 17.

The heat sterilizer (UHT) 18 includes the heating unit 12, the holding tube 14, the first stage cooling unit 15 and the second stage cooling unit 16. A heating-water line 31 is connected between the heating unit 12 and the first stage cooling unit 15. The heating-water line 31 supplies the heating unit 12 with heating water, such as heating water having a temperature of 110° C., from the first stage cooling unit 15. Further, a cooling-water line 32, which supplies the first stage cooling unit 15 with cooling water, such as cooling water having a temperature of 40° C., is connected therebetween. In addition, a cooling-water line 37, which supplies cooling water, such as cooling water of 10° C., is connected to the second stage cooling unit 16.

Figure 3:
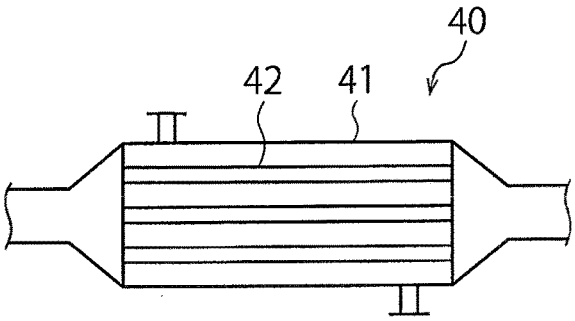
FIG. 3 is a view showing a shell-tube type heat exchanger.

As shown in FIG. 3, the heating unit 12 of the UHT 18, the first stage cooling unit 15 thereof and the second stage cooling unit 16 thereof are respectively formed of a shell-tube type heat exchanger 40 including an outer tube 41 and a plurality of tubes 42 disposed inside the outer tube 41. A beverage flows through the outer tube 41, and heating water or cooling water flows through the tubes 42, so that the beverage is heated or cooled in the outer tube 41.

The heating-water line 31 and the cooling-water line 32, which are connected between the heating unit 12 and the first stage cooling unit 15, constitute a sealed circulation line 30. Namely, the heating-water line 31 is connected to the heating unit 12 and then joins with the cooling-water line 32, and the cooling-water line 32 is connected to the first stage cooling unit 15 and is connected to the heating-water line 31, so that the heating-water line 31 and the cooling-water line 32 constitute a sealed circulation line closed from outside.

The heating-water line 31 is provided with a heating-steam supply unit 34 that supplies heating steam to the heating-water line 31. Thus, heating water of e.g., 100° C., which flows through the heating-water line 31, is heated by the heating steam supplied from the heating-steam supply unit 34 up to a high temperature, such as 150° C., so that the heating water turns into aseptic water. Further, the cooling-water line 32 is provided with a pressure pump 35 that pressurizes cooling water.

Thus, heating water and cooling water, which flow through the circulation line 30, are maintained to be aseptic. Further, a connection line 33 is connected to the cooling-water line 32, and aseptic water flowing through the cooling-water line 32 is supplied to the filler 2 through the connection line 33. Supplemental water is supplied from a supplemental-water line 32A to the cooling-water line 32.

In this case, the connection line 33 is connected to the aseptic chamber 3 of the filler 2 through a sprayer or a nozzle 3*a*, so that aseptic water flowing through the connection line 33 is supplied to the aseptic chamber 3 through the sprayer or the nozzle 3*a*.

Next, an operation of the embodiment as structured above is described.

Firstly, a beverage is prepared in the preparation apparatus 1, and is sent from the balance tank 5 to the heat sterilizer (UHT) 18. The beverage is subjected to a heat sterilization process in the heat sterilizer 18.

Then, the beverage having been sterilized by heat in the heat sterilizer 18 is stored in the serge tank 19, and is thereafter sent to the head tank 11. Thereafter, the beverage in the head tank 11 is supplied to the filler 2 to pass through the filling nozzle 2*a* in the filler 2, so that a bottle b is filled with the beverage in the aseptic condition. The bottle b filled with the beverage is discharged outside from the filler 2.

Next, an operation in the heat sterilizer 18 is described in detail below.

Figure 1:
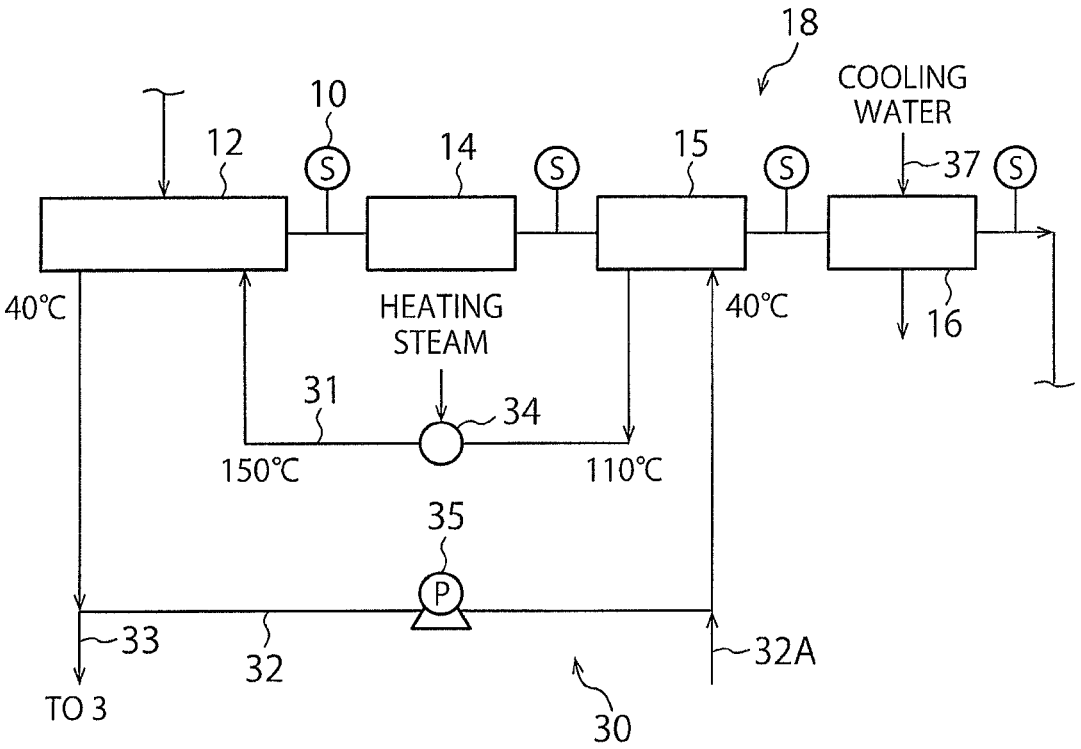
FIG. 1 is a view showing a heat sterilizer of an aseptic filling system.

As shown in FIG. 1, a beverage supplied from the balance tank 5 is sent to the heating unit 12 of the heat sterilizer 18. The beverage of, e.g., an ordinary temperature (20° C.), is heated in the heating unit 12 up to, e.g., 130° C. While the beverage is being heated from 20° C. up to 130° C., the beverage is subjected to a heat sterilization process.

Then, the beverage having been heated in the heating unit 12 is held or heated in the holding tube 14 by a not-shown heating mechanism up to a target temperature of e.g., 130° C.

Then, the beverage from the holding tube 14 is cooled in the first stage cooling unit 15, so that its temperature lowers from 130° C. down to, e.g., 60° C.

Further, the beverage having been cooled by the first stage cooling unit 15 is cooled by the second stage cooling unit 16, so that its temperature lowers from, e.g., 60° C. down to, e.g., 30° C.

Then, the beverage having been cooled by the second stage cooling unit 16 is sent to the serge tank 19 through the manifold valve 8.

During these steps, hot water (heating water like boiling water) having a high temperature of, e.g., 150° C., which flows through the heating-water line 31, is supplied into the heating unit 12, and the beverage is heated in the heating unit 12. The temperature of the heating water that heats the beverage in the heating unit 12 lowers down to, e.g., 40° C. Thus, the heating water having turned into cooling water flows through the cooling-water line 32. Then, the cooling water in the cooling-water line 32 is pressurized by the pressure pump 35, and is supplied to the first stage cooling unit 15. The pressurized cooling water cools the high-temperature beverage in the first stage cooling unit 15. In the first stage cooling unit 15, the temperature of the cooling water elevates from, e.g., 40° C. up to 110° C., so that the cooling water turns into hot water (heating water like boiling water). The hot water enters the heating-water line 31.

Then, heating steam is supplied from the heating-steam supply unit 34 to the heating water flowing through the heating-water line 31, so that the temperature of the heating water elevates from, e.g., 110° C. up to 150° C.

Since the circulation line 30 composed of the heating-water line 31 and the cooling-water line 32, which is shown in FIG. 1, is a sealed line sealed from outside, the heating water and the cooling water flowing through the circulation line 30 are maintained to be aseptic.

During these steps, aseptic cooling water flowing through the cooling-water line 32 is supplied to the filler 2 through the connection line 33 according to need. Since the connection line 33 is connected to the aseptic chamber 3 of the filler 2 through the sprayer 3*a*, the aseptic cooling water flowing through the connection line 33 is sprayed into the aseptic chamber 3 through the sprayer 3*a*, so as to maintain the inside of the aseptic chamber 3 to be aseptic.

As described above, according to this embodiment, the aseptic cooling water in the cooling-water line 32 of the circulation line 30 is supplied to the filler 2 by the connection line 33 and is sprayed into the aseptic chamber 3, whereby the inside of the aseptic chamber 3 can be maintained to be aseptic. Since aseptic water is supplied into the aseptic chamber 3, it is not necessary to additionally provide an aseptic-water generator. Thus, installation cost and operation cost can be reduced as a whole.

1A Aseptic filling system
1 Preparation apparatus
2 Filler
2*a* Filling nozzle
3 Aseptic chamber
3*a* Sprayer
5 Balance tank
6 Return path
7 Beverage supply pipe
7*a* Upstream pipe part
7*b* Downstream pipe part
7*c* Connection pipe part
11 Head tank
12 Heating unit
14 Holding tube
15 First stage cooling unit
16 Second stage cooling unit
18 Heat sterilizer
30 Circulation line
31 Heating-water line
32 Cooling-water line
33 Connection line
34 Heating-steam supply unit
35 Pressure pump
37 Cooling water line

What is claimed is:

1. An aseptic filling system comprising:

a heat sterilizer that sterilizes a content by heat; and a filling machine that fills a bottle with the content sterilized by heat by the heat sterilizer;

wherein:

the heat sterilizer includes a heating unit that heats the content, and a cooling unit that cools the content heated by the heating unit;

a circulation line that circulates aseptic water is connected between the heating unit and the cooling unit, the circulation line including a heating-water line that supplies the heating unit with heating water from the cooling unit, and a cooling-water line that supplies the cooling unit with cooling water from the heating unit; and the hot water which has cooled the content at the cooling unit is supplied into the heating unit through the heating-water line, and heats the content at the heating unit, a portion of the cooling water which has heated the content at the heating unit is supplied into the cooling unit through the cooling-water line, and cools the content at the cooling unit, and the cooling-waterline is provided with a connection line that supplies aseptic water to the filling machine.

2. The aseptic filling system according to claim 1, wherein:

the filling machine includes an aseptic chamber;

the connection line is connected to the aseptic chamber through a sprayer or a nozzle; and aseptic water is sprayed into the aseptic chamber by the sprayer or the nozzle.

3. The aseptic filling system according to claim 2, wherein the heating-water line is provided with a heating-steam supply unit.

4. The aseptic filling system according to claim 1, wherein the heating-water line is provided with a heating-steam supply unit.

* * * * *